US006837754B1

(12) United States Patent
Walton

(10) Patent No.: US 6,837,754 B1
(45) Date of Patent: Jan. 4, 2005

(54) FAST CHANGE TRANSFORMER CONNECTOR

(76) Inventor: Christopher E. Walton, 1110 NW. 91 St., Miami, FL (US) 33150

( * ) Notice: Subject to any disclaimer, the term of this patent is extended or adjusted under 35 U.S.C. 154(b) by 0 days.

(21) Appl. No.: 10/305,859

(22) Filed: Nov. 27, 2002

(51) Int. Cl.[7] ..... H01R 11/09
(52) U.S. Cl. ..... 439/798; 439/801; 439/957
(58) Field of Search ..... 439/796–798, 439/790, 721, 724, 801, 805, 957, 905

(56) References Cited

U.S. PATENT DOCUMENTS

| | | | | | |
|---|---|---|---|---|---|
| 3,742,410 | A | | 6/1973 | Smith | 336/65 |
| 3,794,963 | A | * | 2/1974 | Cooper, Jr. | 439/798 |
| 3,808,587 | A | * | 4/1974 | Lipp et al. | 439/724 |
| 3,936,592 | A | | 2/1976 | Gamble | 174/153 |
| 4,225,839 | A | | 9/1980 | Martincic | 336/96 |
| 4,270,110 | A | | 5/1981 | Martincic et al. | 336/174 |
| 4,307,365 | A | | 12/1981 | Martincic | 336/96 |
| 4,456,326 | A | * | 6/1984 | Sauber | 439/540.1 |
| 4,925,332 | A | | 5/1990 | Griffith | 403/373 |
| 5,915,998 | A | | 6/1999 | Stidham et al. | 439/723 |
| 5,931,708 | A | | 8/1999 | Annas et al. | 439/798 |
| 6,361,375 | B1 | | 3/2002 | Sinclair | 439/723 |
| 2002/0064978 | A1 | | 5/2002 | France | 439/100 |
| 2004/0005823 | A1 | * | 1/2004 | An | 439/801 |

* cited by examiner

*Primary Examiner*—Hae Moon Hyeon
(74) *Attorney, Agent, or Firm*—Yi Li

(57) ABSTRACT

A fast change electric transformer connector is disclosed, which includes a cable connector having a cable attachment body with a plurality of cable attachment ports, a connector extension connected to the cable attachment body, and a stud slide adaptor connected to a side of the connector extension; and a stud screw adaptor complimentary to a transformer stud, for connecting the transformer stud and the stud slide adaptor of the cable connector. Further disclosed is a transformer adaptor, which includes an inter-connector having a screw threaded end for connecting to a cable connector, and a stud slide adaptor for adapting to a transformer stud; and a stud screw adaptor for connecting the transformer stud and the stud slide adaptor of the inter-connector. Using the transformer connector or adaptor of the present invention, a transformer can be replaced rapidly without disconnecting cables.

20 Claims, 5 Drawing Sheets

FAST CHANGE TRANSFORMER CONNECTOR

FIELD OF THE INVENTION

The present invention relates to the field of electric power distribution, and, more specifically, to fast change transformer connectors, which enable changing a transformer without disconnecting electric cables from the connectors.

BACKGROUND OF THE INVENTION

Transformers are key components presently in electric power distribution networks. Generally, electric power is distributed from electrical substations at high voltage typically in excess of 6,000 volts to minimize losses. Transformers are required to reduce the voltage down to lower levels, such as 120 volts, for local distribution to commercial and residential customers A transformer commonly used for this purpose is housed in a steel cabinet on a concrete platform or pad at ground level. The transformer itself includes primary and secondary coils housed in an oil-filled transformer well, the oil being provided to keep the coils cool. Typically, studs, to which cables, or in a general term, conductors, carrying high voltage power to the primary coils, and to which cables carrying reduced voltage from the secondary coils can be attached, protrude laterally outward from the transformer through the wall of the transformer well.

The studs are insulated from the wall of the transformer well by an insulating bushing or seal, which must be impermeable to the oil filling the transformer well. There are usually two to six studs for attaching incoming cables to the primary side, and three to four studs for attaching outgoing cables to the secondary side. Typically, there are a minimum of three studs required on the secondary side, one for each of two phases and one for a return or ground cable.

Transformers of this type may be used to deliver electric power to a relatively small number of end consumers. To supply each such consumer, one cable from each of the studs on the secondary side of the transformer is required. Typically, then, a number of cables are connected to each of the studs, one for each of the consumers being served.

Transformer connectors are used to attach the individual cables to the studs.

One of the most commonly used transformer connectors is spade connector. A spade connector has a female connection end which is screwed onto a transformer stud through the screw threads on both of the stud and the spade connector. Each cable end encapsulated in a cable end lug is screwed onto the spade connector by a set of screw through one of the cable adapting ports of the spade connector.

With these traditional spade connectors, when a transformer needs to be replaced because it is no longer functioning, an electrician has to disconnect each of the cables, usually from three to thirty cables, before the spade connector can be taken off from the stud by rotating the spade connector around the stud. Moreover, each disconnected cable has to be grounded immediately for safety reasons. After the old transformer is replaced by a new transformer and the spade connectors are connected onto the studs of the new transformer, each one of the disconnected cables then has to be bolted onto the spade connector again.

Furthermore, the cable end lug closest to the stud on the spade connector are relatively difficult to access. To reach a set of bolt and nut for a cable end lug axially closest to the stud along the cable, the electrician must reach in toward the stud over a number of cables. Even worse, the inner set bolts may not be readily visible, forcing the electrician to work blindly. Moreover, as the three or four studs are often arranged one above the other on the wall of the transformer well, the electrician may often be required to reach between two layers of cables to adjust the blot of a cable attached close to a stud. Still further, bolts might have become corroded causing extreme difficulty in removing the cables.

It is apparent that this is a lengthy and labour intensive process. It usually takes from about two and half hours to about three hours to change a transformer that carries thirty electrical cables, mainly because the time required for disconnecting and connecting the cables to the spades.

Attempts have been made to address these problems. One such attempt is multi-tap stud connectors. A multi-tap stud connector has a block structure with a transformer stud port and a plurality of cable ports. A multi-tap stud connector is connected to a transformer stud through the transformer stud port and fastened by screws along the side of the transformer stud port. To disconnect the multi-tap stud connector, one loosens the screws, typically two, and detaches the multi-tap stud connector from the transformer stud without disconnecting electrical cables. The multi-tap stud connectors are currently used as an after market product, to replace spade connectors during replacement of a non-functioning transformer. Multi-tap stud connectors have certain disadvantages. As described above, a multi-tap stud connector is connected to a transformer stud through the transformer stud port and fastened by two screws along the side of the transformer stud port. Such a connection is not as secure as the connection of a traditional spade connector, which is directly bolted on to the transformer stud. Furthermore, multi-tap connectors are made of aluminum, which is different from the transformer stud material of brass. For a long term use, the connection between aluminum and brass tends to become loose, causing poor connection between the transformer and the connector. For most transformers, particularly the large transformers, spade connectors are still the most commonly used in the field.

Therefore, it is apparent that there exists a continuing need to provide improved transformer connectors that enable the rapid change of a transformer and reduce power supply downtime. The present invention represents a novel approach toward a solution of the problems associated with the lengthy and labor intensive process involved in changing transformers.

SUMMARY OF THE INVENTION

In the first embodiment, the present invention provides transformer connectors which enable fast replacement of an electric transformer without disconnecting electrical cables. The transformer connector comprises a cable connector having a cable attachment body with a plurality of cable attachment ports, a connector extension connected, to the cable attachment body, and a stud slide adaptor connected to a side of the connector extension; and a stud screw adaptor complimentary to a transformer stud, for connecting the transformer stud and the stud slide adaptor of the cable connector.

In the second embodiment, the present invention provides a transformer adaptor, which can be used to connect an electrical cable connector to a transformer stud. The transformer adaptor comprises an inter-connector comprising a connecting shaft having screw threads at one end; and a stud slide adaptor connected to a side of the connecting shaft at the opposing end; and a stud screw adaptor complimentary to a transformer stud, for connecting the transformer stud and the stud slide adaptor of the inter-connector. The transformer adaptor of the present invention can be used with existing transformer connectors, such as spade connectors, for conveniently detach the transformer connectors without disconnecting the electrical cables.

BRIEF DESCRIPTION OF THE DRAWINGS

The above and other features and advantages of the present invention will be more clearly understood from the following detailed description taken in conjunction with the accompanying drawings, in which.

DETAILED DESCRIPTION OF THE INVENTION

Figure 1:
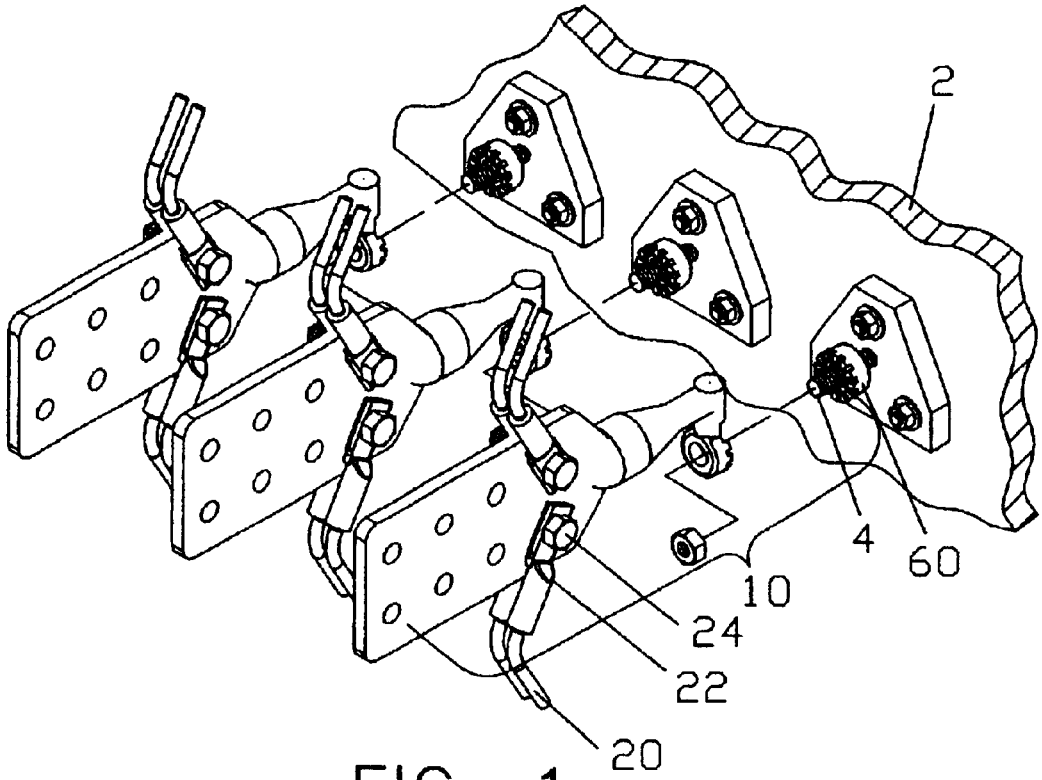
FIG. 1 is a perspective view of three transformer connectors of the present invention, showing the stud slide adaptor of the transformer connectors to be attached to each of three studs of the transformer with electrical cables attached to each of the transformer connectors.

Referring now to the drawings. As shown in FIG. 1, three transformer connectors 10 of the present invention are to be attached to a transformer 2. A plurality of electrical cables 20 are attached to transformer connector 10, wherein each cable 20 is connected to transformer connector 10 through a cable end lug 22, and secured onto transformer connector 10 by a set of bolt and nut 24. Each cable 20 provides electricity from transformer 2 to a user.

Figure 2:
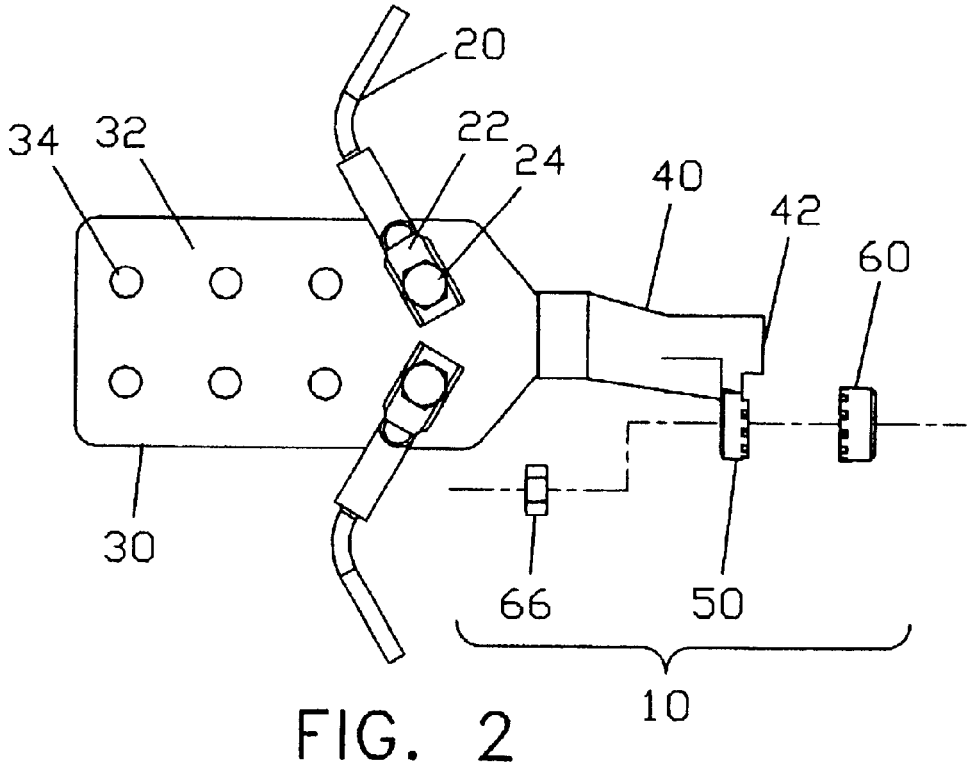
FIG. 2 is a side view of a transformer connector of one embodiment of the present invention.

As shown in FIG. 2, transformer connector 10 comprises an electrical cable connector 30, and a stud screw adaptor 60 which is complimentary to a transformer stud, for connecting transformer stud and cable connector 30. The cable connector 30 includes a cable attachment body 32 having a plurality of cable attachment ports 34; a connector extension 40 connected to cable attachment body 32; and a stud slide adaptor 50 connected to a side of connector extension 40 near the end 42 of connector extension 40. The transformer connector 10 further includes a bolt nut 66 for securing stud slide adaptor 50 onto a transformer stud 4.

Figure 3A:
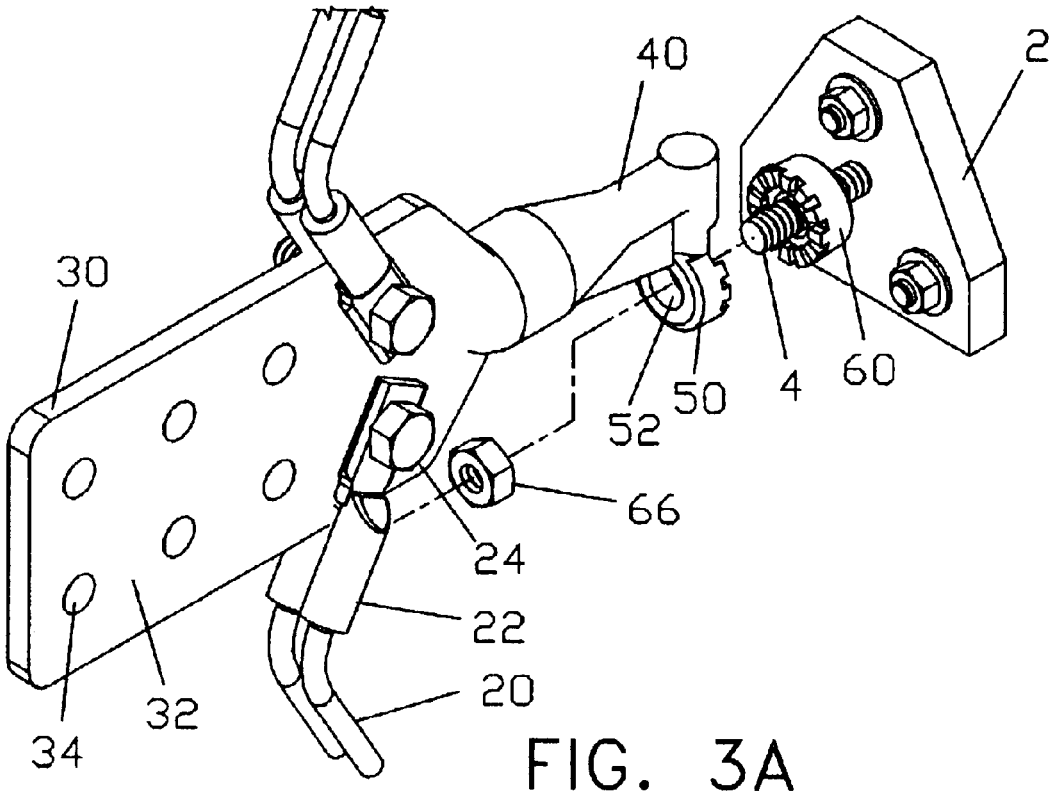
FIG. 3A and 3B are perspective views of the transformer connector shown in FIG. 2, showing the stud slide adaptor of the transformer connector to be attached to a stud of a transformer.
Figure 3B:
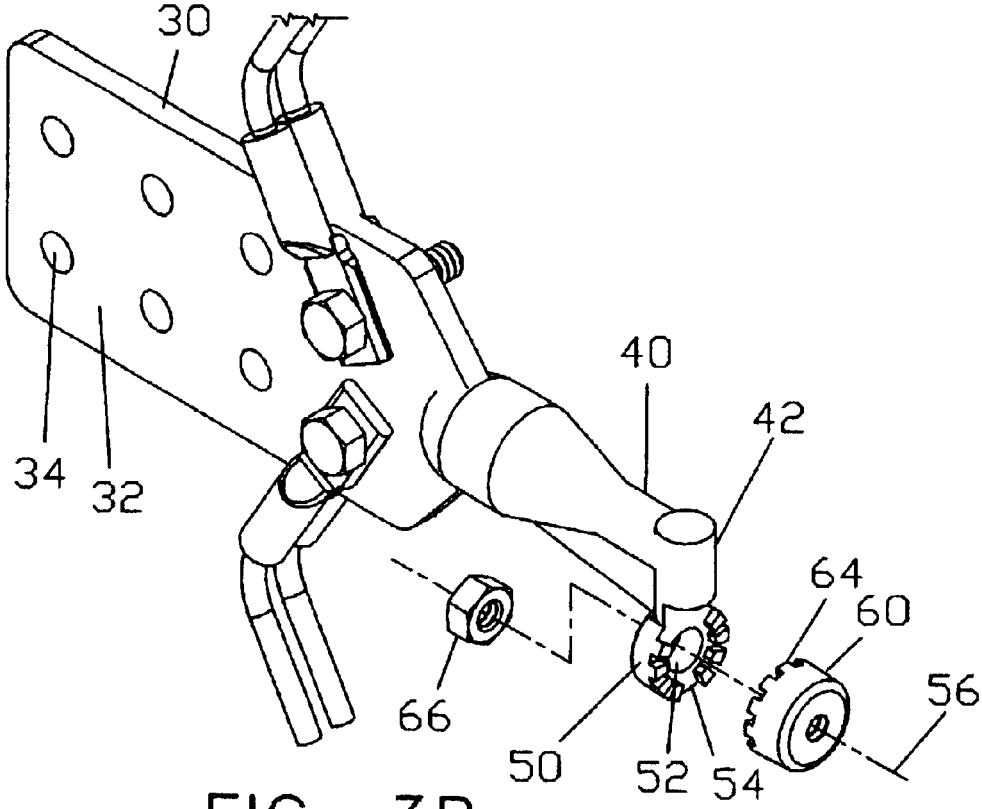
Figure 4A:
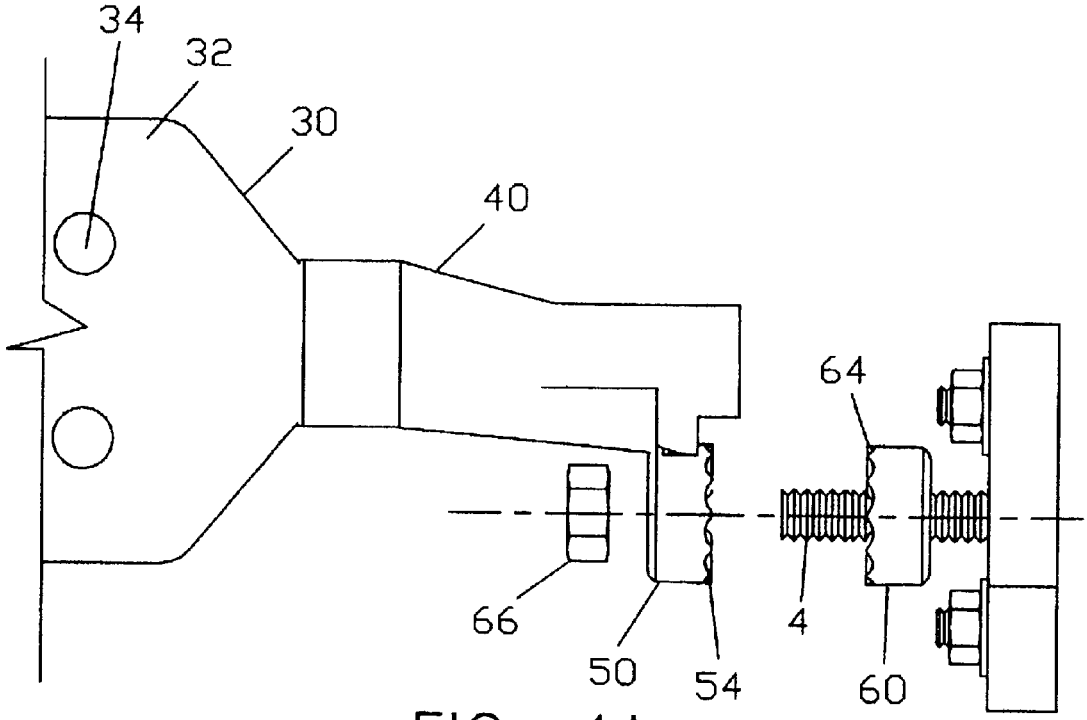
FIG. 4A and 4B are side views of the transformer connectors of one embodiment of the present invention, showing two different geometry shapes at contact surfaces of the stud slide adaptor and stud screw adaptor.
Figure 4B:
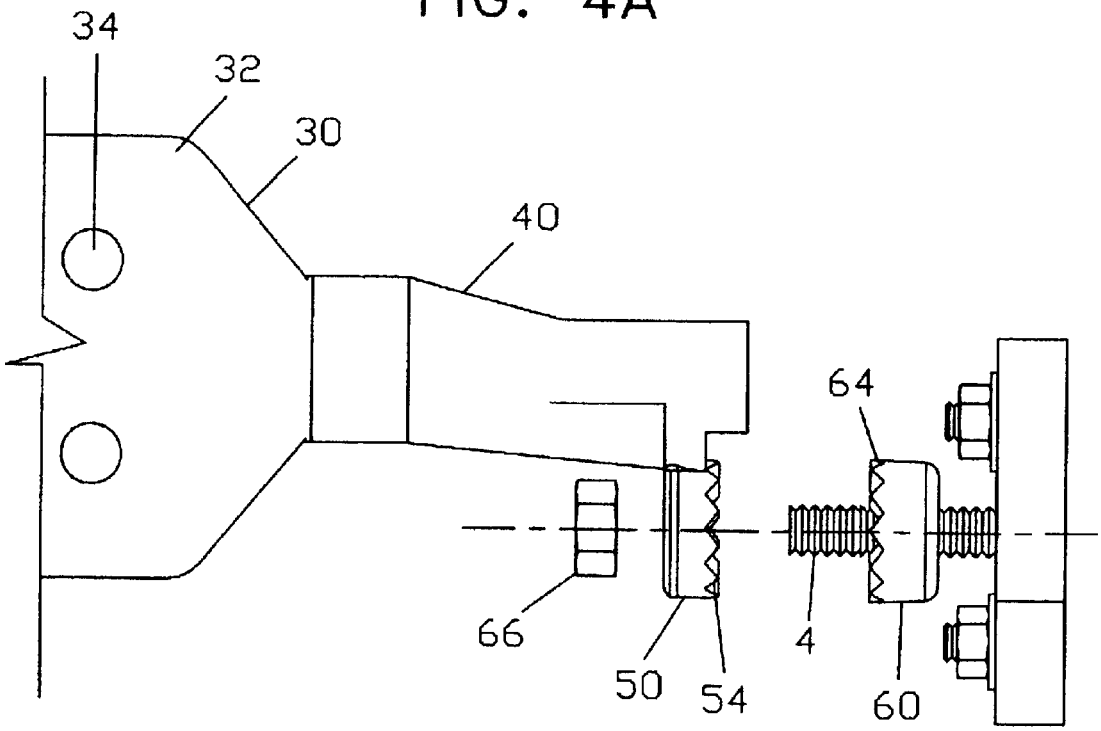
Figure 5A:
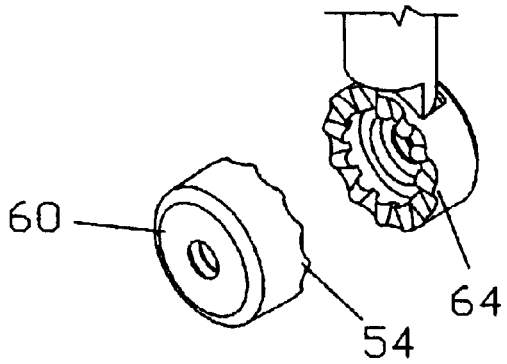
FIG. 5A and 5B are perspective views of the contact surfaces of the stud slide adaptor and stud screw adaptor of transformer connectors shown in FIG. 4A and 4B, respectively.
Figure 5B:
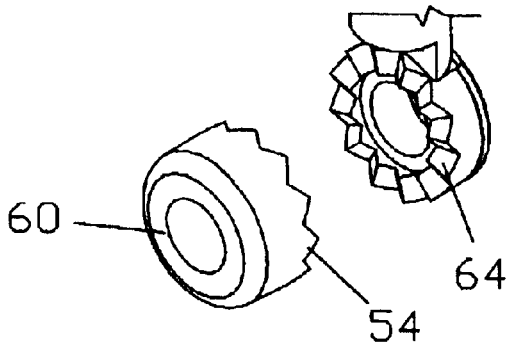

As shown in FIG. 3A and 3B, stud slide adaptor 50 has a circular opening 52 for adapting to transformer stud 4. The diameter of circular opening 52 is greater than the diameter of transformer stud 4, so that stud slide adaptor 50 can be conveniently adapted onto transformer stud 4. The stud slide adaptor 50 has a contact surface 54, which is in perpendicular to a central axis 56 of circular opening 52. The contact surface 54 interfaces with a contact surface 64 of stud screw adaptor 60. As shown, contact surfaces 54 and 64 can have a complimentary geometry shape for providing maximum surface contact between the two surfaces. FIG. 3A and 3B show a rectangular teeth shape at contact surfaces 54 and 64. However, various shapes can be utilized, such as sine wave shape and triangular shape shown in FIG. 4A, 4B, 5A and 5B, and a flat surface. Preferably, contact surfaces 54 and 64 have a large contact area, and a smooth contact in order to conduct electricity effectively, and to avoid poor connections.

Furthermore, a proper complimentary geometry shape, such as rectangular teeth shape, sine wave shape and triangular shape also provide an inter-locking mechanism between stud slide adaptor 50 and stud screw adaptor 60. The inter-locking interface facilities an electrician's assembling process, and ensures proper contact between stud slide adaptor 50 and stud screw adaptor 60.

The external shape and size of stud slide adaptor 50 and stud screw adaptor 60 can be the same, as shown in the FIG. 2, 3A and 3B. However, they can also be different. For example, stud screw adaptor 60 can be a larger block with a circular central indentation complimentary to the external shape and size of stud slide adaptor 50. In this type of structure, stud slide adaptor 50 can be inserted into the indentation to ensure a proper connection. The bolt nut 66 is a regular commercially available bolt nut as long as it is compatible with transformer stud 4.

Preferably, cable connector 30 has an integrated structure having cable attachment body 32, connector extension 40, and stud slide adaptor 50 moulded together. An integrated structure provides structural strength, and reduces connection interfaces, which is desired for conducting electricity effectively. The cable connector 30 can be made of copper, iron, aluminum, and other suitable electrical conducting materials.

Figure 6:
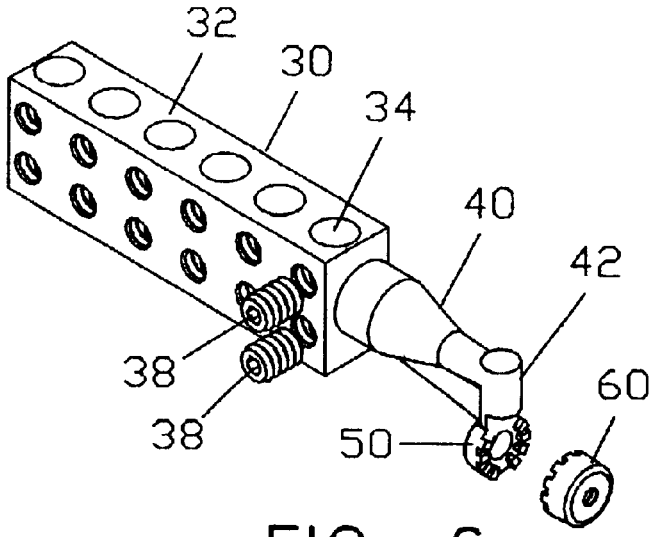
FIG. 6 is a perspective view of the transformer connector having a multi-tap block as the cable attachment body of one embodiment of the present invention.

As shown in FIG. 2, 3A and 3B, cable attachment body 32 has a structure of traditional spade connector. However, other suitable structures, such as a structure of multiple tap stud connector, can also be used, as illustrated in FIG. 6. As shown in FIG. 6, cable attachment body 32 merely connects electrical cables 20 through cable attachment ports 34, which are secured by a pair of screws 38. It is understood that the connection with transformer is provided by stud slide adaptor 50 and stud screw adaptor 60, regardless of the shape and mechanism of cable attachment body 32. Several existing transformer connectors can be modified by incorporating connector extension 40 and stud slide adaptor 50 of the present invention. Their individual cable connection mechanism can be maintained.

The connector extension 40 as shown is a straight circular shaft with a enforcement rim. However, other suitable shapes and structures, such as a square shape at the cross section of the shaft, and with a certain angle along the shaft, can also be utilized for the purpose of the present invention. The length and diameter of the shaft can be determined depending on the structure of cable attachment body 32, the number of cables, and the weight that the transformer connector 30 carries.

The transformer connector of the present invention provides a convenient connection mechanism between the transformer and the electrical cables. To connect transformer connector 10 to transformer 2, an electrician first screws stud screw adaptor 60 onto transformer stud 4, then slides stud slide adaptor 50 onto transformer stud 4 and engages stud screw adaptor 60, and last screws on bolt nut 66 to tighten the connection between stud slide adaptor 50 and stud screw adaptor 60. To disconnect transformer connector 10 from transformer 2, the electrician simply reverses the process described above. Since no rotation is required to unscrew cable connector 30 around transformer stud 4, once electrical cables 20 are connected to cable connector 30, they do not need to be disconnected in the process of changing transformer. Moreover, when cable connector 30 is disconnected from transformer stud 4 during the change of transformer, only one time grounding of cable connector 30, instead of grounding of disconnected each cable, is required. This convenient connection mechanism, provided by the engagement of stud slide adaptor 50 and stud screw adaptor 60 with transformer stud 4, offers substantial reduction of time and labour involved in replacing a transformer. The estimated time for changing a transformer connected with thirty cables can be reduced from an original two and half to three hours down to thirty minutes to about one hour. With such a substantial reduction on the electrical power supply downtime, the impacts on financial recovery of consumers, particularly manufacturers, cost reduction of power suppliers, and consumer living conditions are enormous. Therefore, the transformer connector of the present invention has important economical, financial and social significance.

In the second embodiment, the present invention is related to a transformer adaptor. As shown in FIG. 6, transformer adaptor 70 comprises an inter-connector 80, and a stud screw adaptor 60 for connecting inter-connector 80 and transformer stud 4. The inter-connector 80 includes a connecting shaft 82 which has embedded male screw threads at one end 84, also called cable end; and a stud slide adaptor 50 connected to a side of said connecting shaft at the opposing end 86, also called transformer end. The transformer adaptor 70 further includes a bolt nut 66.

The structures of stud slide adaptor 50 and stud screw adaptor 60 of transformer adaptor 70, and the mechanism of connection to transformer 2 are the same as those of transformer connector 10 described in detail in the first embodiment.

Figure 7:
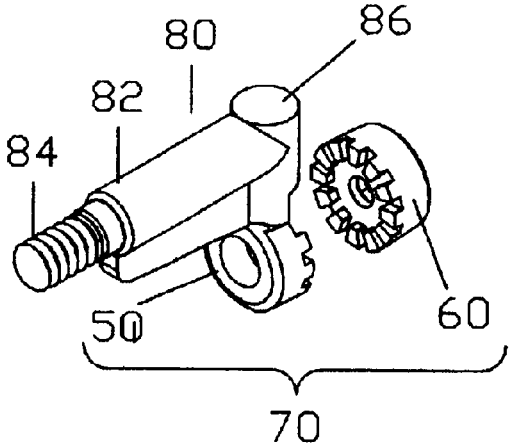
FIG. 7 is a perspective view of the transformer adaptor of one embodiment of the present invention.
Figure 8:
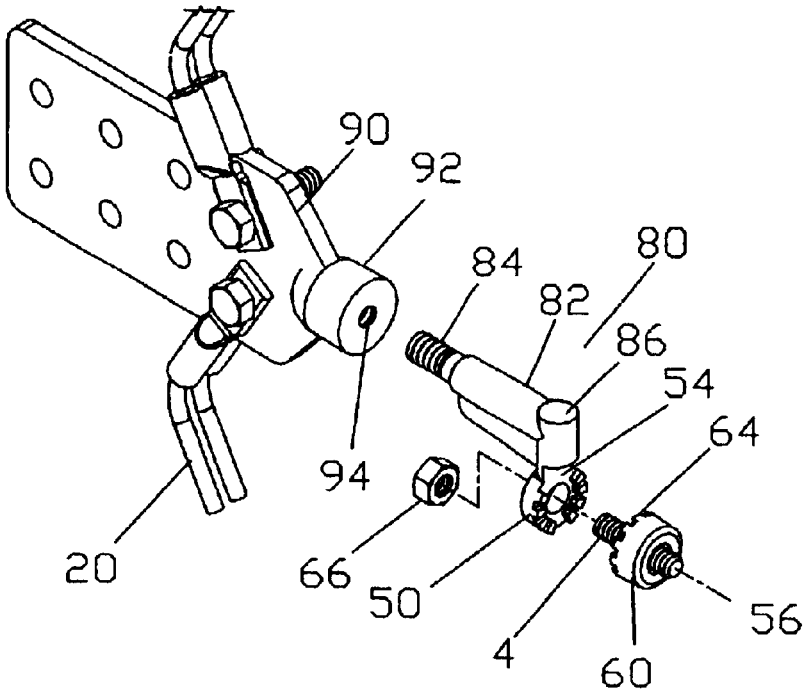
FIG. 8 is a perspective view of the transformer adaptor of one embodiment of the present invention, which is to be connected to a traditional spade connector and a transformer stud.
Figure 9:
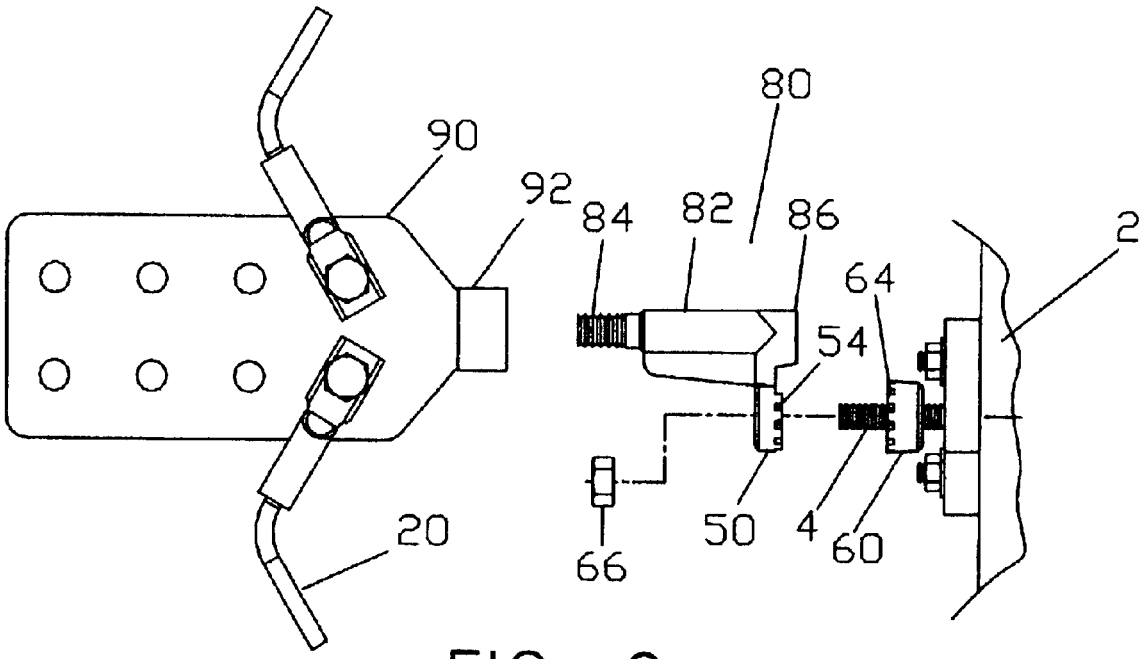
FIG. 9 is a side view of the transformer adaptor shown in FIG. 8.

As illustrated in FIG. 7 and 8 and 9, transformer adaptor 70 is used to connect a cable connector which has embedded female screw threads within the body of the cable connector, which is commonly used for connecting to transformer stud 4. FIG. 8 shows the female adapting end 92 of a traditional spade connector 90. Traditionally, to connect spade connector 90 onto transformer 2, an electrician turns spade connector 90 around transformer stud 4, then attach cables 20 to spade connector 90. To disconnect spade connector 90 from transformer 2, the electrician has to disconnect each individual cable 20 before spade connector 90 can be turned around transformer stud 4 in the opposite direction.

With transformer adaptor 70 of the present invention, one can continue to use existing spade or other connectors without disconnecting electrical cables from these connectors. As shown in FIGS. 8 and 9, to connect a conventional spade connector 90 to transformer 2, the electrician first adapts inter-connector 80 to spade connector 90 by screwing cable end 84 of inter-connector 80 into female adapting end 92 of spade connector 90, and screws stud screw adaptor 60 onto transformer stud 4, then slides stud slide adaptor 50 of inter-connector 80 onto transformer stud 4, and last screws bolt nut 66 to tighten the connection between stud slide adaptor 50 and stud screw adaptor 60. Using inter-connector 80, electrical cables 20 can be attached to spade connector 90 before or after spade connector 90 is connected to transformer 2.

To disconnect spade connector 90 from transformer 2 for replacing transformer, the electrician can simply disconnect transformer adaptor 70 from transformer stud 4 by taking off bolt nut 66, and sliding stud slide adaptor 50 out from transformer stud 4. Cables 20 do not need to be disconnected from spade connector 90. As discussed previously, the convenient connection mechanism provided by the present invention enables a fast change of a transformer by eliminating the steps of disconnecting individual cables.

The screw threads at cable end 84 of inter-connector 80 should be complimentary to the female screw threads of a specific connector of which the transformer adaptor 70 is used for. The material and structural features of transformer adaptor 70 are similar to those described previously for transformer connector 10.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. A transformer connector comprising:

(a) a cable connector comprising a cable attachment body having a plurality of cable attachment ports; a connector extension having first end and an opposing second end, said first end being connected to said cable attachment body; and a stud slide adaptor connected to a side of said connector extension adjacent to said second end, said stud slide adaptor having an opening for adjacent attaching said cable connector to a transformer stud; and (b) a stud screw adaptor complimentary to said transformer stud, for connecting said transformer stud and said stud slide adaptor of said cable connector.

2. The transformer connector of claim 1 further comprising a bolt nut adaptable to said transformer stud for securing a connection between said stud slide adaptor and said stud screw adaptor of said cable connector.

3. The transformer connector of claim 1, wherein said stud slide adaptor has a circular opening for adapting to said transformer stud and a contact surface, in perpendicular to a center axis of said circular opening.

4. The transformer connector of claim 3, wherein said contact surface of said stud slide adaptor is complementary to a contact surface of said stud screw adaptor.

5. The transformer connector of claim 4, wherein said contact surfaces of said stud slide adaptor and said stud screw adaptor have a complimentary geometry shape for providing contact between said stud slide adaptor and said stud screw adaptor.

6. The transformer connector of claim 5, wherein said complimentary geometry shape comprises rectangular teeth shape, sine wave shape, triangular shape, and flat shape.

7. The transformer connector of claim 5, wherein said contact surfaces of said stud slide adaptor and said stud screw adaptor are interlocking.

8. The transformer connector of claim 1, wherein said cable attachment body is a traditional spade connector body.

9. The transformer connector of claim 1, wherein said transformer connector is made of an electrical conductive material.

10. A transformer adaptor comprising:

(a) an inter-connector comprising a connecting shaft having external screw threads at a first end for connecting to a cable connector; and a stud slide adaptor connected to a side of said connecting shaft adjacent to an opposing second end thereof, said stud slide adaptor having an opening for slidably attaching said inter-connector to a transformer stud; and (b) a stud screw adaptor complimentary to said transformer stud, for connecting said transformer stud and said stud slide adaptor of said inter-connector.

11. The transformer adaptor of claim 10 further comprising a bolt nut adaptable to said transform stud for securing a connection between said stud slide adaptor and said stud screw adaptor of said inter-connector.

12. The transformer adaptor of claim 10, wherein said connecting shaft enables a connection with a cable connector having complimentary female adapting means through said screw threads of said connecting shaft.

13. The transformer adaptor of claim 12, wherein said cable connector is a traditional spade connector.

14. The transformer adaptor of claim 10, wherein said stud slide adaptor has a circular opening for adapting to said transformer stud and a contacting surface, in perpendicular to a center axis of said circular opening.

15. The transformer adaptor of claim 14, wherein said contact surface of said stud slide adaptor is complementary to a contact surface of said stud screw adaptor.

16. The transformer adaptor of claim 15, wherein said contact surfaces of said stud slide adaptor and said stud screw adaptor have a complimentary geometry shape for providing contact between said stud slide adaptor and said stud screw adaptor.

17. The transformer adaptor of claim 16, wherein said complimentary geometry shape comprises rectangular teeth shape, sine wave shape, triangular shape, and flat shape.

18. The transformer adaptor of claim 16, wherein said contact surfaces of said stud slide adaptor and said stud screw adaptor are interlocking.

19. The transformer adaptor of claim 1, wherein said transformer adaptor is made of an electrical conductive material.

20. A transformer connector comprising:

(a) a cable connector comprising a cable attachment body having a plurality of cable attachment ports; a connector extension having a first end and an opposing second end, said first end being connected to said cable attachment body; and a stud slide adaptor connected to a side of said connector extension adjacent to said second end, in perpendicular to a longitudinal axis of said connection extension; said stud slide adaptor having an opening for slidably attaching said cable connector to a transformer stud;

(b) a stud screw adaptor complimentary to said transformer stud, for connecting said transformer stud and said stud slide adaptor of said cable connector; and (c) a bolt nut complementary to said transformer stud for securing a connection between said stud slide adaptor and said stud screw adaptor of said cable connector.

* * * * *